United States Patent [19]

Takamatsu

[11] 3,984,901

[45] Oct. 12, 1976

[54] SLIDE FASTENER STRINGER WITH A ZIGZAG-SHAPED CONTINUOUS COUPLING ELEMENT

[75] Inventor: Ikuo Takamatsu, Uozu, Japan

[73] Assignee: Yoshida Kogyo Kabushiki Kaisha, Japan

[22] Filed: Dec. 27, 1974

[21] Appl. No.: 536,999

[30] Foreign Application Priority Data

Dec. 28, 1973 Japan ..... 49-5001[U]

[52] U.S. Cl. ..... 24/205.16 C; 24/205.13 C; 24/205.16 D

[51] Int. Cl.² ..... A44B 19/40; A44B 19/10

[58] Field of Search ..... 24/205.13 C, 205.16 C, 24/205.1 C

[56] References Cited

UNITED STATES PATENTS

| | | | |
|---|---|---|---|
| 1,859,572 | 5/1932 | Poux | 24/205.13 C |
| 3,328,857 | 7/1967 | Burbank | 24/205.13 C |
| 3,336,640 | 8/1967 | Chery | 24/205.13 C |
| 3,710,429 | 1/1973 | Spindler | 24/205.13 C |

*Primary Examiner*—Bernard A. Gelak
*Attorney, Agent, or Firm*—Buchnam and Archer

[57] ABSTRACT

A continuous coupling element is fashioned from an elongated synthetic resin filament or the like, which filament is bent to a zigzag or meandering configuration to provide a series of U-shaped transverse portions each having a coupling head and a pair of legs extending rearwardly therefrom. Parts of the legs of each U-shaped portion are deformed to provide tape gripping portions, respectively, which include laterally expanded, flat surfaces arranged in opposed relationship to each other. The continuous coupling element is to be anchored to a stringer tape as by bonding or fusing the tape gripping portions to the opposite surfaces of the tape.

3 Claims, 2 Drawing Figures

SLIDE FASTENER STRINGER WITH A ZIGZAG-SHAPED CONTINUOUS COUPLING ELEMENT

BACKGROUND OF THE INVENTION

This invention relates generally to slide fasteners, and in particular to the improved construction of a slide fastener stringer having a continuous coupling element of zigzag-shaped or meandering configuration.

It has been proposed, in connection with a slide fastener stringer of the type now under consideration, to affix the continuous coupling element to the stringer tape by bonding or fusing. The construction of the prior art continuous coupling element is such, however, that the stringer tape must be specially formed to permit the positive anchorage thereon of the bonded or fused coupling element. For example, the longitudinal edge portion of the stringer tape must be corrugated or perforated. This conventional manner of element affixation to the tape is unnecessarily complex and time-consuming from the standpoint of this invention.

SUMMARY OF THE INVENTION

It is, therefore, an object of this invention to provide a slide fastener stringer of the type including a continuous coupling element of zigzag-shaped or meandering configuration which can be readily and securely affixed to a stringer tape of no special construction.

Another object of the invention is to provide a slide fastener stringer of the type described, such that the continuous coupling element can be affixed to the stringer tape without substantially impairing the desired flexibility of the tape.

With these and other objects in view, this invention aims at the provision of a slide fastener stringer with a continuous coupling element of the so-called zigzag configuration including a series of ladder-like transverse portions which are each substantially U-shaped. Each U-shaped transverse portion consists of a coupling head and a pair of legs extending rearwardly therefrom, and the rear ends of the legs are connected by a series of longitudinal portions each of which interconnect two adjacent transverse portions and which are alternately arranged on the opposite sides of the stringer tape. Characteristically, parts of the legs of each U-shaped transverse portion of the continuous coupling element are deformed partially into a cooperative pair of tape gripping portions including laterally expanded, flat surfaces, respectively, that are opposed to each other to hold the stringer tape therebetween.

This improved configuration permits the continuous coupling element to be positively affixed to the stringer tape, as by having its tape gripping portions bonded or fused thereto, because the opposed flat surfaces of these portions serve to significantly increase the contact surfaces of the coupling element with the tape. Furthermore, as the continuous coupling element is bonded or fused to the stringer tape only at the opposed surfaces of its tape gripping portions, the desired flexibility of the tape is not substantially impaired. The stringer tape itself need not be specially formed to permit the positive affixation of the coupling element thereto, so that the production of the fastener stringer is highly expedited.

The above and other objects, features, and advantages of the improved slide fastener stringer according to the invention will become more readily apparent from the following description of a typical form thereof, in which reference is made to the accompanying drawings wherein like reference characters refer to like parts throughout the several views.

DESCRIPTION OF THE PREFERRED EMBODIMENT

Figure 1:
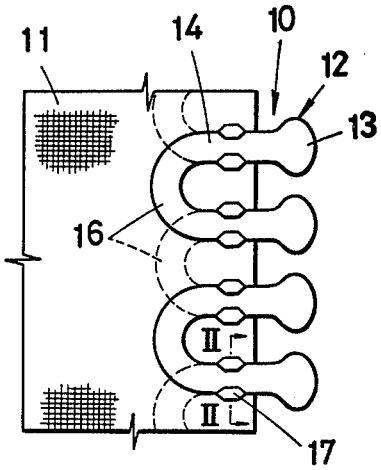
FIG. 1 is a partial plan view of a slide fastener stringer constructed in accordance with the novel concepts of this invention.

In FIG. 1 a preferred form of the slide fastener stringer according to the invention is shown with its continuous coupling element 10 attached to one of the longitudinal edges of a stringer tape 11. The continuous coupling element 10 can be fashioned from a continuous filament of synthetic resin or like material, which filament is bent to a zigzag configuration to provide a series of ladder-like transverse portions 12. All these transverse portions 12 are substantially U-shaped, as will be seen by referring also to FIG. 1. A series of uniformly intersticed coupling heads 13 are formed at the front ends, or the right hand ends as viewed in FIG. 1, of the respective U-shaped transverse portions 12 for mating interengagement with the similar coupling heads of a companion stringer (not shown). A pair of legs or shanks 14 and 15 extend rearwardly from each coupling head 13 and are arranged in a plane perpendicular to the plane of the stringer tape 11. The rear ends, or the left hand ends as viewed in FIG. 1, of the legs 14 and 15 are connected by a series of longitudinal connective portions 16 each of which interconnect two adjacent U-shaped portions 12 and which are alternately located on the opposite sides of the stringer tape 11.

The zigzag-shaped or meandering continuous coupling element of the above described general organization has been known in the art, and no feature of this invention resides in the stringer construction as so far set forth.

Figure 2:
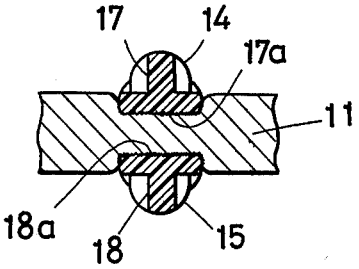
FIG. 2 is a sectional view taken along the plane of line II—II in FIG. 1.

According to the novel concepts of the invention, the corresponding parts of the legs 14 and 15 or each U-shaped transverse portion 12 are so deformed as to provide a pair of tape gripping portions 17 and 18 having opposed, laterally expanded, flat surfaces **17*a*, and 18*a*, respectively, that are arranged in parallel spaced relationship to each other as best illustrated in FIG. 2. The tape gripping portions 17 and 18 may be formed by exerting pressure on the selected lateral portions of each leg 14 or 15**.

The continuous coupling element 10 incorporating the novel concepts of this invention can be readily and securely affixed to the stringer tape 11 by inserting the longitudinal edge portion of the latter between the legs 14 and 15, so that the coupling heads 13 project forwardly or outwardly therefrom, and by bonding the opposed surfaces **17*a* and 18*a* of the tape gripping portions 17 and 18 to the stringer tape by use of a suitable adhesive or by fusing these portions to the stringer tape as by the well known high-frequency or ultrasonic welding techniques. Alternatively, the continuous coupling element 10 can be stitched to the stringer tape 11**.

The various objects of the invention are believed to have been fully accomplished by the preferred form of the slide fastener stringer shown and described hereinbefore. It will be easy, however, for those skilled in the art to resort to various modifications of the invention within the broad teaching hereof. It is therefore understood that the invention is not to be restricted by the exact showing of the drawings or the description thereof but is inclusive of all such modifications falling within the scope of the claim which follows.

What is claimed is:

1. In a slide fastener stringer of the type including a stringer tape, and a continuous coupling element mounted on said stringer tape, said continuous coupling element having a zigzag configuration including a series of ladder-like transverse portions each of which has a coupling head and a pair of legs extending rearwardly therefrom to hold a longitudinal edge portion of said stringer tape therebetween, said continuous coupling element also including a series of longitudinal connective portions each interconnecting two adjacent transverse portions and alternately located on the opposite sides of said stringer tape, the improvement which comprises on each pair of said legs means defining a tape gripping portion extending over a limited length portion of a respective leg and having a transverse cross-section different from that of the remainder of the leg toward both legs ends and defining a flat surface, the flat surfaces of each pair of tape gripping portions being disposed in opposite spaced-apart relation to each other and in engagement with respective opposite sides of the stringer tape to secure the coupling element thereto, each of said tape gripping portions being disposed intermediate a respective coupling head and a respective connective portion.

2. The improvement according to claim 1 wherein said flat surfaces of the tape gripping portions are bonded to the stringer tape.

3. In a slide fastener stringer of the type including a stringer tape, and a continuous coupling element mounted on said stringer tape, said continuous coupling element having a zigzag configuration including a series of ladder-like transverse portions each of which has a coupling head and a pair of legs extending rearwardly therefrom to hold a longitudinal edge portion of said stringer tape therebetween, said continuous coupling element also including a series of longitudinal connective portions each interconnecting two adjacent transverse portions and alternately located on the opposite sides of said stringer tape, the improvement which comprises on each pair of said legs means defining a tape gripping portion extending over a limited length portion of a respective leg and having a transverse cross-section different from that of the remainder of the leg and defining a flat surface, the flat surfaces of each pair of tape gripping portions being disposed in opposite spaced-apart relation to each other and in engagement with respective opposite sides of the stringer tape to secure the coupling element thereto, said tape gripping portions having T-shaped transverse cross-sections.

* * * * *